US009679544B2

(12) United States Patent
Yang

(10) Patent No.: US 9,679,544 B2
(45) Date of Patent: Jun. 13, 2017

(54) BOW FOR STRING INSTRUMENTS

(71) Applicant: Yinan Yang, Taiwan (CN)

(72) Inventor: Yinan Yang, Taiwan (CN)

( * ) Notice: Subject to any disclaimer, the term of this patent is extended or adjusted under 35 U.S.C. 154(b) by 193 days.

(21) Appl. No.: 14/654,584

(22) PCT Filed: May 26, 2015

(86) PCT No.: PCT/CN2015/079788
§ 371 (c)(1),
(2) Date: Jun. 22, 2015

(87) PCT Pub. No.: WO2016/176883
PCT Pub. Date: Nov. 10, 2016

(65) Prior Publication Data

US 2017/0140741 A1 May 18, 2017

(30) Foreign Application Priority Data

May 6, 2015 (CN) ..... 2015 1 0225238
May 6, 2015 (CN) ..... 2015 2 0287572 U

(51) Int. Cl.
*G10D 3/16* (2006.01)

(52) U.S. Cl.
CPC ..... *G10D 3/16* (2013.01)

(58) Field of Classification Search
CPC ..... G10D 3/16
See application file for complete search history.

(56) References Cited

U.S. PATENT DOCUMENTS 748,286 A * 12/1903 Keast ..... G10D 3/16 84/282
764,558 A * 7/1904 Carlson ..... G10D 3/16 84/282
833,463 A * 10/1906 Kane ..... G10D 3/16 84/282
868,169 A * 10/1907 Doster ..... G10D 3/16 84/282
1,151,413 A * 8/1915 Steckenreiter ..... G10D 3/16 84/282
1,327,433 A * 1/1920 Jelinek ..... G10D 3/16 84/282
1,427,851 A * 9/1922 Rigg ..... G10D 3/16 84/282
1,461,096 A * 7/1923 Rigg ..... G10D 3/16 84/282
1,566,914 A * 12/1925 Newman ..... G10D 3/16 84/282
1,912,961 A * 6/1933 Allison ..... G10D 3/16 84/282

(Continued)

*Primary Examiner* — Robert W Horn

(57) ABSTRACT

A bow includes: a stick, a bow head at a front end of the stick, a frog at a tail end of the stick; and a bow hair tightly connected between the bow head and the frog. The bow further includes: a first hair binding terminal and a second hair binding terminal, respectively for mounting two ends of the bow hair; a locking screw, for fixing the first hair binding terminal at the bow head by rotating tight, and releasing the fixed first hair binding terminal by rotating loose; and a cover, slidably provided on the frog, wherein the cover slides back and forth to detachably fix the second hair binding terminal in the frog.

10 Claims, 6 Drawing Sheets

(56) References Cited

U.S. PATENT DOCUMENTS

| | | | | | |
|---|---|---|---|---|---|
| 2,003,161 | A * | 5/1935 | Turner | G10D 3/16 | 84/282 |
| 2,252,929 | A * | 8/1941 | Heddon | G10D 3/16 | 84/282 |
| 2,258,998 | A * | 10/1941 | Nebel | G10D 3/16 | 84/282 |
| 2,263,793 | A * | 11/1941 | Woerner | G10D 3/16 | 84/282 |
| 2,466,168 | A * | 4/1949 | Graydon | G10D 3/16 | 261/69.2 |
| 2,483,486 | A * | 10/1949 | Brown | G10D 3/16 | 84/282 |
| 2,624,225 | A * | 1/1953 | Nebel | G10D 3/16 | 84/282 |
| 3,456,544 | A * | 7/1969 | Glasser | G10D 3/16 | 84/282 |
| 3,545,330 | A * | 12/1970 | Nosco | G10D 3/16 | 401/195 |
| 3,759,131 | A * | 9/1973 | Brock | G10D 3/16 | 84/282 |
| 3,919,912 | A * | 11/1975 | Darling | G10D 3/16 | 84/282 |
| 3,979,992 | A * | 9/1976 | Gandillet | G10D 3/16 | 84/282 |
| 3,991,647 | A * | 11/1976 | Darling | G10D 3/16 | 84/282 |
| 4,015,501 | A * | 4/1977 | Schaller | G10D 3/16 | 84/282 |
| 4,020,731 | A * | 5/1977 | Darling | G10D 3/16 | 411/957 |
| 6,777,600 | B2 * | 8/2004 | Daring | G10D 3/16 | 84/274 |
| 7,795,515 | B2 * | 9/2010 | Bartholomew | G10D 3/16 | 473/561 |
| 9,006,546 | B2 * | 4/2015 | Kunstadt | G10D 3/16 | 84/282 |

* cited by examiner

BOW FOR STRING INSTRUMENTS

CROSS REFERENCE OF RELATED APPLICATION

This is a U.S. National Stage under 35 U.S.C. 371 of the International Application PCT/CN2015/079788, filed May 26, 2015, which claims priority under 35 U.S.C. 119(a-d) to CN 201520287572.2, filed May 6, 2015.

BACKGROUND OF THE PRESENT INVENTION

Field of Invention

The present invention relates to bows for string instruments, and more particularly to a bow capable of flexibly replacing a bow hair.

Description of Related Arts

Conventionally, the bow for the string instrument has the two ends of the bow hair respectively tied up into two bundles, wherein the first end is fixed into the mortise of the bow head by inserting the wooden wedge and the second end is fixed into the mortise of the frog by inserting another wooden wedge. The bow hair of the conventional bow is usually made of the white, grey or black horsehair. The stick of the conventional bow is mostly made of elastic wood. The bow makes sound by rubbing the strings with the horsehairs; however, the horsehairs are liable to snap while the horsehairs frequently rub the strings.

The bow of the violin is taken as an example. The amateur violin players may have to replace the bow hair once every two or three years; the professional violin players basically replace the bow hair once per year. During disassembling and installing the bow hair, the conventional fixation manner of the bow hair is liable to damage the bow head and the frog. In order to protect the bow from the damage induced by replacing the bow hair, it requires professional technicians to disassemble and install the bow hair.

Moreover, the violin players need to cleanse the bow hair in the daily maintenance of the bow. Due to the conventional fixation manner of the bow hair, it is impossible to disassemble the bow hair from the bow each time the violin player cleanses the bow hair; whereas, directly cleansing the bow having the bow hair fixed therein would cause the water penetration into the bow head and the frog, so as to damage the bow head and the frog.

Therefore, it is necessary to provide a bow capable of flexibly replacing the bow hair to protect the bow from damage.

SUMMARY OF THE PRESENT INVENTION

An object of the present invention is to provide a bow having a bow hair detachably fixed on the bow, so as to accomplish flexibly replacing the bow hair.

Another object of the present invention is to provide a bow capable of protecting a bow head and a frog of the bow during replacing a bow hair.

Another object of the present invention is to provide a bow which successively and respectively uses two opposite surfaces of a bow hair to play, so as to elongate a service life of the bow hair.

Another object of the present invention is to provide a bow configured to fix bow hairs of different lengths, so as to adapt to a gradual elongation of the bow hair.

Yet another object of the present invention is to provide a bow whose bow hair is provided flat between a bow head and a frog.

Accordingly, in order to accomplish the above objects, the present invention provides a bow for string instruments, comprising:

a stick;

a bow head, mounted at a front end of the stick, wherein a surface of the bow head has a first groove which is transversally provided;

a frog, mounted at a tail end of the stick, wherein a surface of the frog has a second groove which is transversally provided;

a first hair binding terminal, embedded within the first groove, in such a manner that the first hair binding terminal is transversally embedded into or detached from the bow head along the first groove;

a second hair binding terminal, embedded within the second groove, in such a manner that the second hair binding terminal is transversally embedded into or detached from the frog along the second groove;

a bow hair, having two ends respectively fixed with the first hair binding terminal and the second hair binding terminal, thereby being tightly connected between the bow head and the frog;

a locking screw, detachably connected to the bow head and the first hair binding terminal, wherein the locking screw is tightened to fix the first hair binding terminal at the first groove and loosened to release the first hair binding terminal which is fixed, in such a manner that the first hair binding terminal is detachably fixed in the bow head; and a cover, provided above the second groove, and slidably provided on the surface of the frog, wherein the cover slides into the frog to cover up the second hair binding terminal for restricting the second hair binding terminal within the second groove, and slides out of the frog to release the second hair binding terminal which is restricted, in such a manner that the second hair binding terminal is detachably fixed in the frog.

The first hair binding terminal has an upper row and a lower row of first serrations which are mutually engaged; a front end of the bow hair is clipped between the upper row and the lower row of the first serrations, and thus fixed inside the first hair binding terminal.

The second hair binding terminal has an upper row and a lower row of second serrations which are mutually engaged; a final end of the bow hair is clipped between the upper row and the lower row of the second serrations, and thus fixed inside the second hair binding terminal.

Preferably, a cross section of the first hair binding terminal has a tenon, and accordingly a cross section of the first groove has a mortise for engaging with the tenon. Therefore, the first hair binding terminal is transversally embedded into or detached from the bow head merely along the first groove.

Preferably, the cross section of the first hair binding terminal is in an upper and lower symmetry, so that the first hair binding terminal after being turned upside down by 180° is still able to be embedded into the first groove; or, the cross section of the first hair binding terminal is in a left and right symmetry, so that the first hair binding terminal after being turned leftside right by 180° is still able to be embedded into the first groove, so as to accomplish flipping the bow hair.

Preferably, the surface of the frog has at least two second grooves which are arranged horizontally; a distance from each second groove to the first groove successively enlarges, respectively for fixing the bow hair of different lengths, so as to adapt to a gradual elongation of the bow hair.

Preferably, the bow further comprises a hair separating grating, provided between the first hair binding terminal and the second hair binding terminal. The hair separating grating has a plurality of through-holes horizontally and uniformly arranged. Accordingly, the bow hair is evenly separated into a plurality of groups which respectively penetrate through the through-holes, so the bow hair is flat and evenly connected between the bow head and the frog.

These and other objectives, features, and advantages of the present invention will become apparent from the following detailed description, the accompanying drawings, and the appended claims.

DETAILED DESCRIPTION OF THE PREFERRED EMBODIMENT

Figure 1:
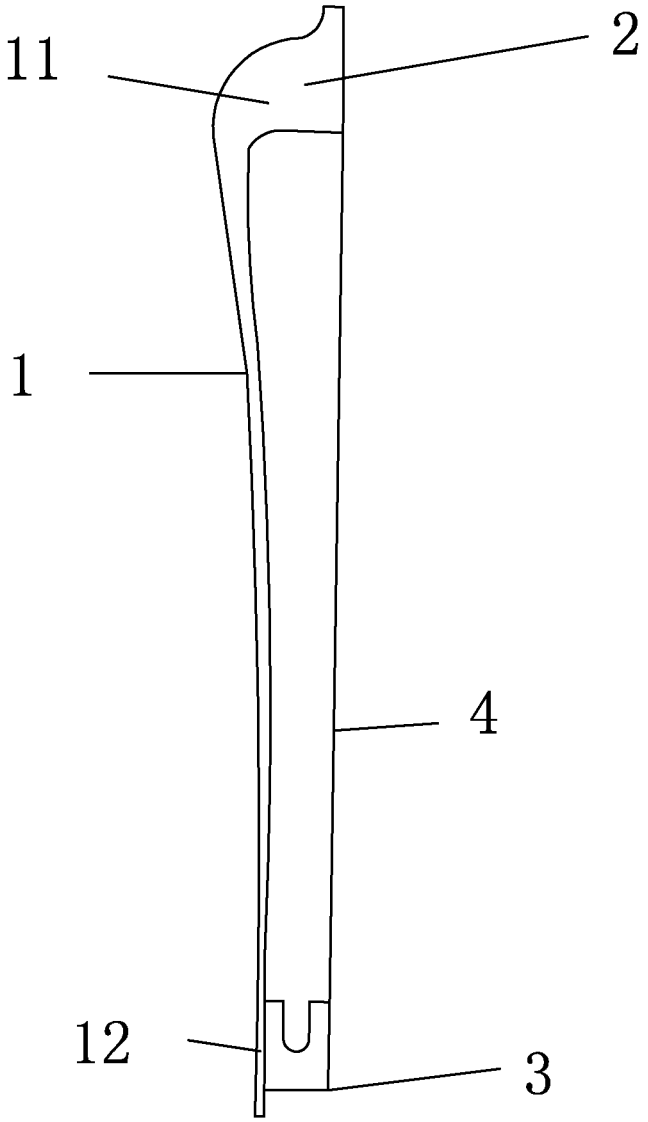
FIG. 1 is a sketch view of a bow for string instruments according to a first preferred embodiment of the present invention.

Referring to FIGS. 1-5 of the drawings, according to a first preferred embodiment of the present invention, a bow for string instruments comprises: a stick 1; a bow head 2, mounted at a front end 11 of the stick 1; a frog 3, mounted at a tail end 12 of the stick 1; and a bow hair 4, having two ends respectively fixed into the bow head 2 and the frog 3, wherein the bow hair 4 is tightly connected between the bow head 2 and the frog 3.

Figure 2:
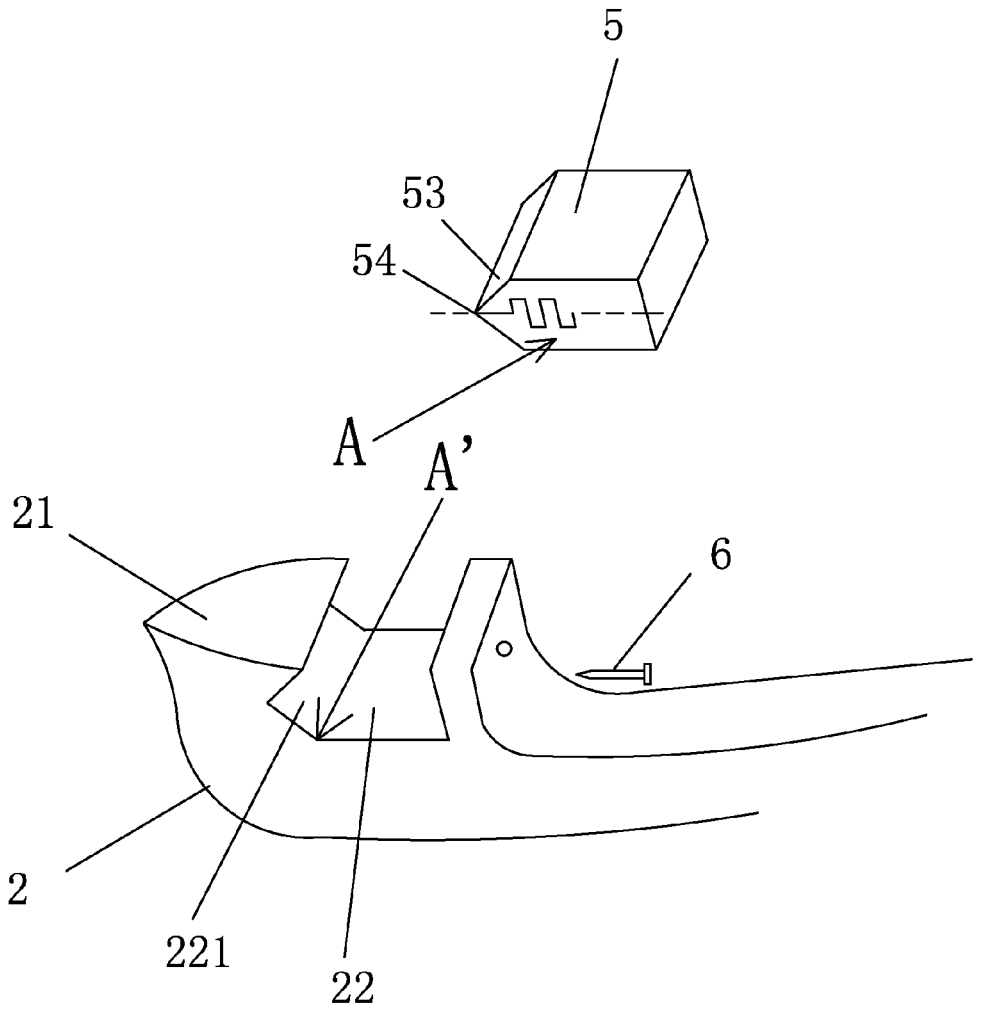
FIG. 2 is an explode view of a bow head according to the first preferred embodiment of the present invention.
Figure 5:
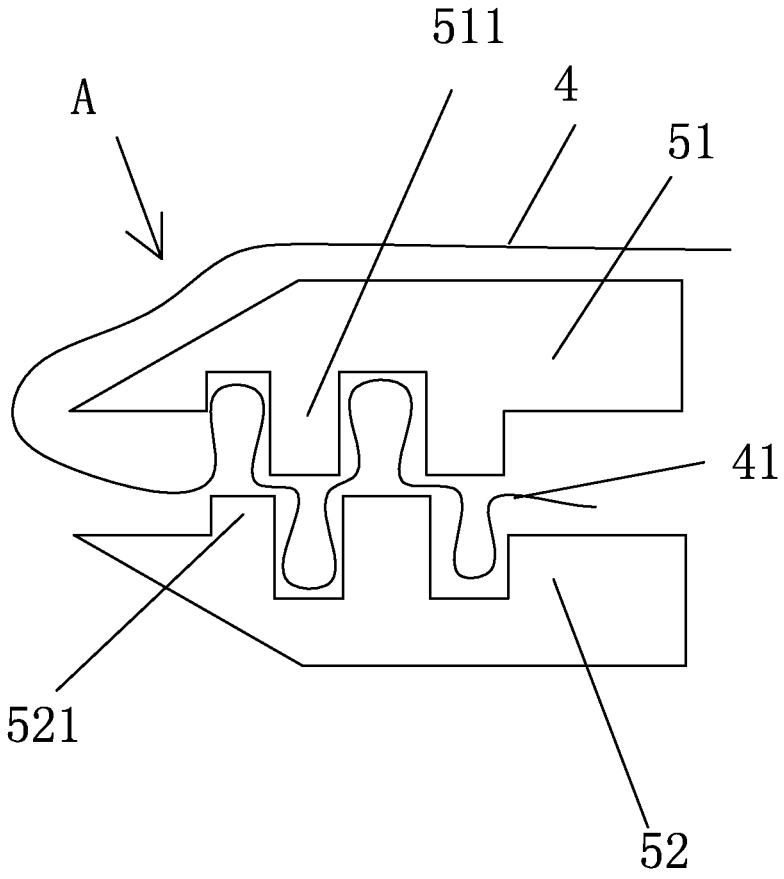
FIG. 5 is a cross sectional view of a first hair binding terminal according to the first preferred embodiment of the present invention.

Referring to FIGS. 2 and 5, a surface 21 of the bow head 2 has a first groove 22 transversally provided, wherein a left side and a right side of the bow head 2 are intercommunicated through the first groove 22. The bow further comprises: a first hair binding terminal 5 for fixing a front end 41 of the bow hair 4, embedded within the first groove 22; and a locking screw 6, connected between the bow head 2 and the first hair binding terminal 5.

A cross section A of the first hair binding terminal 5 matches with a cross section A' of the first groove 22, in such a manner that the first hair binding terminal 5 is capable of transversally entering or leaving the bow head 2 from the left side or the right side of the bow head 2. The front end 41 of the bow hair 4 runs out of the bow head 2 from the first groove 22, and then extends backward.

The locking screw 6 is vertical to the first groove 22. As showed in FIG. 2, the locking screw 6, vertical to the first groove 22, is horizontally rotated into the bow head 2 and the first hair binding terminal 5. The locking screw is rotated tight to enter the bow head 2 and the first hair binding terminal 5, thereby fixing the first hair binding terminal 5 within the first groove 22. The locking screw is rotated loose until the locking screw is detached from the first hair binding terminal 5, thereby releasing the first hair binding terminal 5, so that the first hair binding terminal 5 is capable of freely leaving the bow head along the first groove 22. Therefore, the first hair binding terminal 5 is detachably fixed in the bow head 2.

Figure 3:
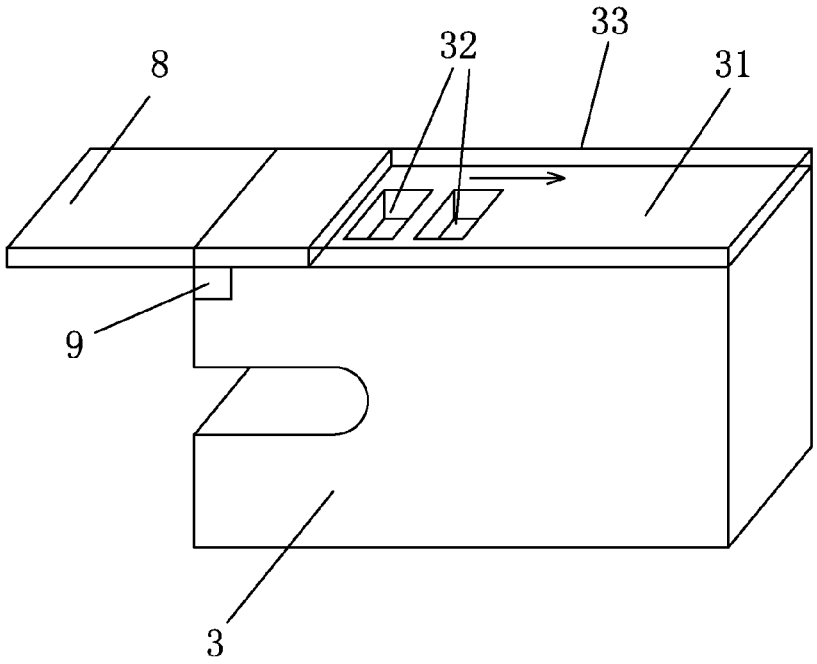
FIG. 3 is a perspective view of a frog according to the first preferred embodiment of the present invention.
Figure 4:
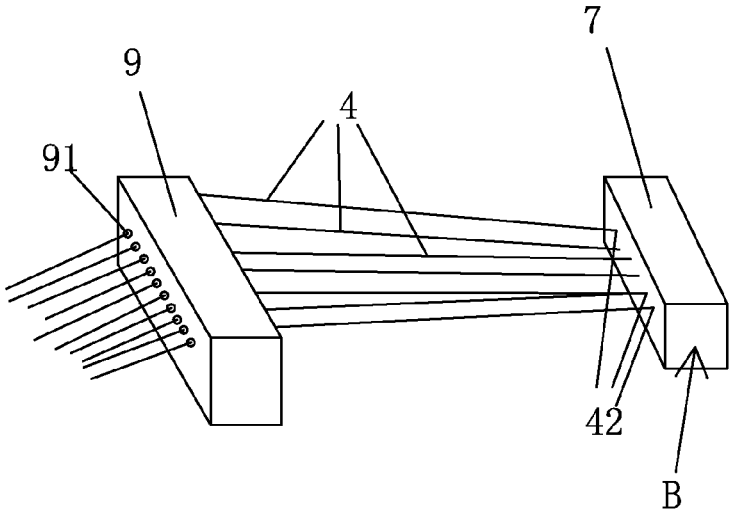
FIG. 4 is a sketch view of a hair binding terminal according to the first preferred embodiment of the present invention.

Referring to FIGS. 3-4, a surface 31 of the frog 3 has two second grooves 32 which are transversally provided. As showed in FIG. 3, a length of the two second grooves 32 is smaller than a length of the surface 31 of the frog 3; the two second grooves 32 are respectively arranged along a horizontal direction as indicated by an arrow; a distance from each second groove to the first groove 22 respectively enlarges, for fixing the bow hair of different lengths.

After a long-term service, the bow hair would be no longer tightly connected between the bow head and the frog as original; the bow hair becomes loose and gradually elongates. In order to adapt to the gradual elongation of the bow hair, the frog has at least one second groove, for fixing the bow hair which elongates. An interval between each two neighboring second grooves can be flexible. According to the first preferred embodiment of the present invention, the bow has the two second grooves; the bow can be embodied to have a different amount of the second grooves according to practical necessity in other preferred embodiments.

Referring to FIGS. 3-4, the bow further comprises: a second hair binding terminal 7 for fixing a final end 42 of the bow hair 4, embedded within one of the second grooves 32; and a cover 8, provided above the second grooves 32, and slidably provided on the surface 31 of the frog 3.

The second hair binding terminal 7 has the same shape with the two second grooves 32, in such a manner that the second hair binding terminal 7 is exactly inserted down into one of the second grooves 32. Furthermore, since the length of the two second grooves 32 is smaller than the length of the surface 31 of the frog 3, the second hair binding terminal 7 is merely vertically embedded into or detached from the second groove 32, so that the second hair binding terminal 7 is only able to vertically enter or leave the frog 3. The final end 42 of the bow hair 4 runs out from the second groove 32, through the cover 8, and out of the frog 3, and then extends forward.

As showed in FIG. 3, the frog 3 has a pair of rails 33, provided on the surface 31 and above the two second grooves 32, wherein the cover 8 slides back and forth through the rails 33. The cover 8 slides into the frog 3 along the rails 33, and then covers up the second hair binding terminal 7 which is embedded within the second groove 32, thereby restricting the second hair binding terminal 7 in the second groove 32. The cover 8 slides out of the frog 3 along the rails 33, and then releases the second hair binding terminal 7 which is restricted. Therefore, the second hair binding terminal 7 is detachably fixed in the frog 3.

As showed in FIGS. 2 and 5, the cross section A of the first hair binding terminal 5 is a combined shape of a triangle and a rectangle, in an upper and lower symmetry. The first hair binding terminal 5 comprises an upper plate 51 and a lower plate 52 which are stacked with each other. A bottom surface of the upper plate 51 has a first row of serrations 511 distributed backward from a front of the bottom surface;

accordingly, a top surface of the lower plate 52 has a second row of serrations 521 distributed backward from a front of the top surface, for mutually engaging with the first row of serrations 511. The front end 41 of the bow hair 4 runs forward to be clipped between the first row of serrations 511 and the second row of serrations 521, so as to be mounted inside the first hair binding terminal 5. The bow hair 4 runs out of the first hair binding terminal 5 from a front end 54 of the first hair binding terminal 5, next folds backward along a gap between the first groove 22 and the first hair binding terminal 5, and then leaves the first groove 22 and the bow head 2. The upper plate 51 and the lower plate 52 forms the first hair binding terminal 5 whose cross section A has a convex tenon 53. The cross section A' of the first groove 22 has a concave mortise 221 for engaging with the tenon 53, in such a manner that the first hair binding terminal 5 is embedded into or detached from the bow head 2 merely transversally along the first groove 22 and is disenabled to vertically get out of the first groove 22. Meanwhile, the tenon 53 and the mortise 221 which are mutually engaged with each other also stabilizes an engagement between the upper plate 51 and the lower plate 52, so as to strengthen the fixation of the front end 41 of the bow hair 4 in the first hair binding terminal 5 and prevent the bow hair 4 from falling off.

The fixation of the final end 42 of the bow hair 4 in the second hair binding terminal 7 can be realized in any known art within the knowledge of ones skilled in the art, or in a manner of serration engagement the same with the fixation of the front end 41 in the first hair binding terminal 5.

Normally the bow hair consists of 200 hairs. For a convenience of illustration, the drawings of the present invention merely show a part of the bow hair for exemplary only.

Because the first hair binding terminal 5 is in the upper and lower symmetry, the first hair binding terminal 5 after being turned upside down still matches with the first groove 22 and is still able to be embedded into the first groove 22, so as to accomplish respectively fixing two opposite surfaces of the bow hair 4 and improve a usage rate of the bow hair.

Unlike the first hair binding terminal 5 which is transversally embedded, the second hair binding terminal 7 is only vertically inserted into the second groove 32. In accordance to fixing the two opposite surfaces of the bow hair, and in order to ensure a flatness of the bow hair, preferably, a cross section B of the second hair binding terminal 7 is in a left and right symmetry, in such a manner that the second hair binding terminal 7 after being turned leftside right by 180° is still able to be inserted into the second groove 32.

As showed in FIGS. 3-4, the bow further comprises a hair separating grating 9, provided between the first hair binding terminal 5 and the second hair binding terminal 7, and fixed under the rails 33 of the frog 3. As showed in FIG. 3, the hair separating grating 9 is at a top left corner of the frog 3, under the rails 33. The hair separating grating 9 is cuboid. Considering that the bow hair 4 normally has about 200 horsehairs, according to the first preferred embodiment of the present invention, the hair separating grating 9 has ten through-holes 91 which are evenly arranged horizontally; correspondingly, the bow hair 4 running out of the second groove 32 is evenly divided into ten groups of the horsehairs, wherein each group is about 20 horsehairs; the ten groups of the horsehairs respectively penetrate through the ten through-holes 91, in such a manner that the bow hair is flat and evenly connected between the bow head and the frog.

Figure 6:
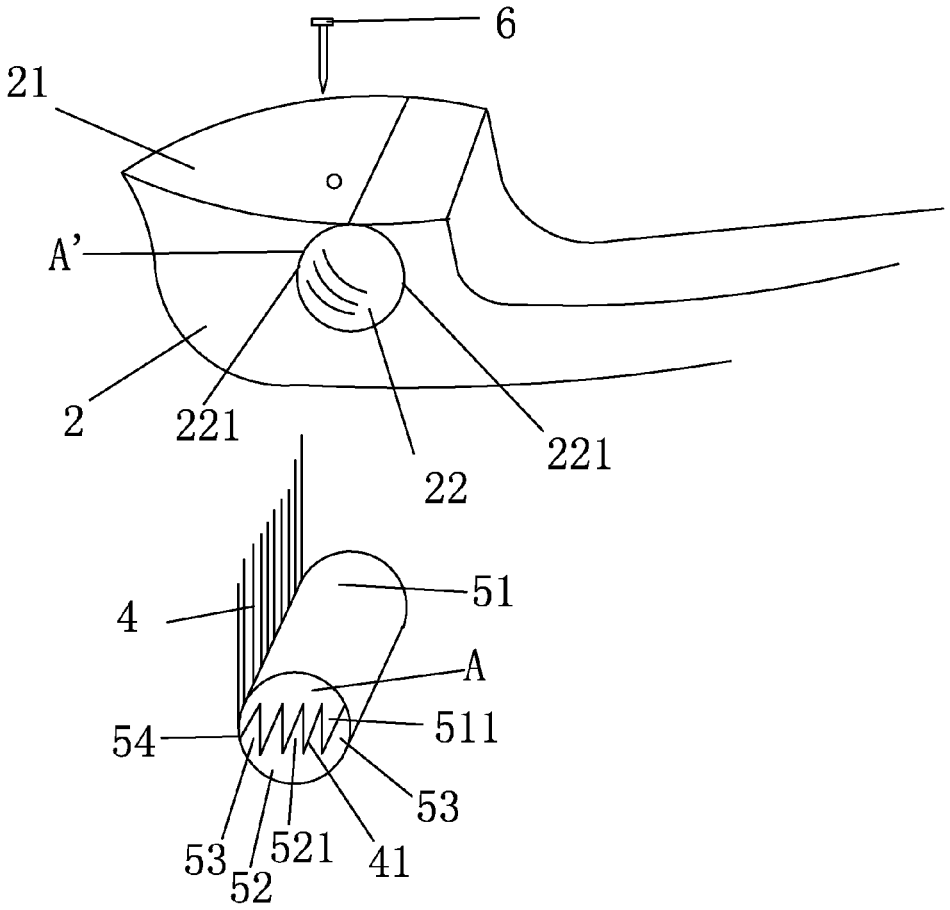
FIG. 6 is an exploded view of the first hair binding terminal according to a second preferred embodiment of the present invention.

Referring to FIG. 6, a second preferred embodiment of the present invention differs with the first preferred embodiment in that: the first hair binding terminal 5 is a cylindrical and the cross section A of the first hair binding terminal 5 is round; accordingly, the first groove 22 is also cylindrical, for allowing the first hair binding terminal 5 to transversally enter or leave the bow head 2; and the locking screw 6, vertical to the first groove 22, is connected to the bow head 2 and the first hair binding terminal 5 straight downward from the surface 21 of the bow head 2. According to the second preferred embodiment of the present invention, the upper plate 51 and the lower plate 52 are engaged with each other to form the first hair binding terminal 5; the bow hair 4 is clipped between the first row of serrations 511 of the upper plate 51 and the second row of serrations 521 of the lower plate 52. According to the second preferred embodiment of the present invention, the first hair binding terminal 5 has two tenons 53, each of which is a semi-circle; the first groove 22 has two concave mortises 221, each of which is a semi-circle and is engaged with each tenon 53, in such a manner that the first hair binding terminal 5 is able to transversally move merely along the first groove 22.

The cross section A of the first hair binding terminal 5 is in an upper and lower symmetry, and also a left and right symmetry. Therefore, no matter turning upside down or leftside right, the first hair binding terminal 5 is still able to be embedded into the first groove 22, so as to respectively fix the two opposite surfaces of the bow hair 4.

When a first surface of the bow hair is in use, a player frequently rubs the first surface of the bow hair so that the first surface may become smooth and show poor performance in making sound. Herein, by turning the first hair binding terminal, the player is able to use a second surface of the bow hair which is below the first surface and not used yet, so as to improve the usage rate of the bow hair.

Figure 7:
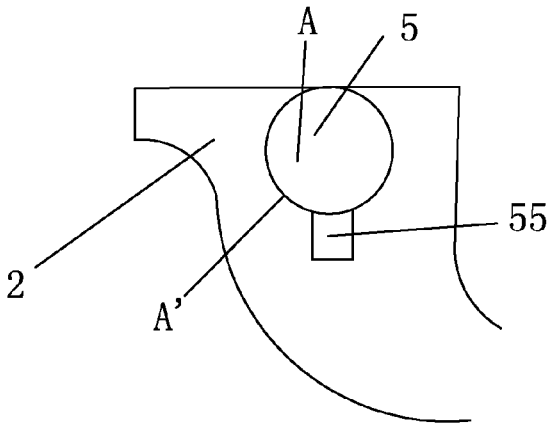
FIG. 7 is a cross sectional view of the first hair binding terminal according to a third preferred embodiment of the present invention.

As showed in FIG. 6, the bow hair 4 runs through the upper plate 51 and the lower plate 52 which are engaged with each other and extends out of the front end 54 of the first hair binding terminal 5. During a practical operation process, when the bow hair 4 is tightly connected between the bow head 2 and the frog 3, a spiccato may induces a great pressure upon the bow hair 4; although the first hair binding terminal 5 is fixed by the locking screw 6, the first hair binding terminal 6 tends to rotate due to a traction of the bow hair 4. The front end 54 of the first hair binding terminal 6 tends to rotate to a top. Therefore, according to a third preferred embodiment of the present invention, as showed in FIG. 7, the first hair binding terminal 5 has a convex hook 55, inserted into the bow head 2, for further preventing the first hair binding terminal from rotation. The locking screw can be rotated into the bow head and the hook 55, so as to fix the first hair binding terminal in the first groove.

Figure 8:
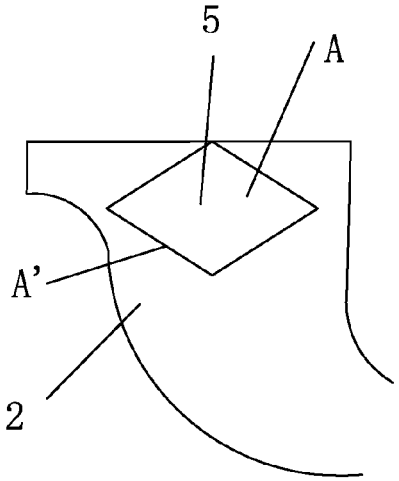
FIG. 8 is a cross sectional view of a first alternative mode of the first binding terminal and a first groove.
Figure 9:
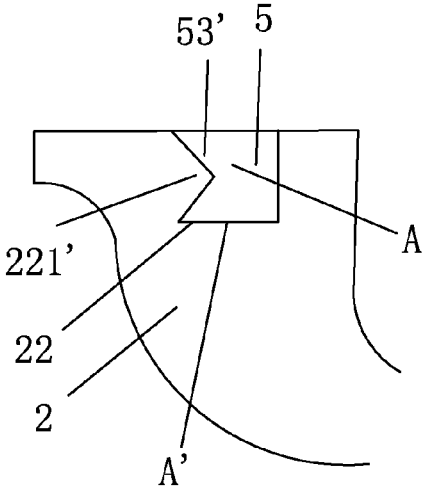
FIG. 9 is a cross sectional view of a second alternative mode of the first binding terminal and the first groove.

As showed in FIG. 8, according to a first alternative mode of the first binding terminal and the first groove, the cross section A of the first hair binding terminal 5 can be a rhombus, not limited to the combined shape of the triangle and the rectangle in the first preferred embodiment or the round shape in the second preferred embodiment. Moreover, the first hair binding terminal 5 can have the mortise while the first groove 22 can have the tenon engaged with the mortise of the first hair binding terminal 5. As showed in FIG. 9, according to a second alternative mode of the first binding terminal and the first groove, the cross section A of the first hair binding terminal 5 has a mortise 53', and the cross section A' of the first groove 22 has a tenon 221' for mutually engaging with the mortise 53', in such a manner that the first hair binding terminal 5 is still embedded into or detached from the bow head 2 merely transversally along the first groove 22.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A bow for string instruments, comprising:

a stick; a bow head, mounted at a front end of the stick, wherein a surface of the bow head has a first groove which is transversally provided; a frog, mounted at a tail end of the stick, wherein a surface of the frog has a second groove which is transversally provided;

a first hair binding terminal, embedded within the first groove, wherein the first hair binding terminal is transversally embedded into or detached from the bow head along the first groove; a second hair binding terminal, embedded within the second groove, wherein the second hair binding terminal is transversally embedded into or detached from the frog along the second groove;

a bow hair, having a front end and a final end respectively fixed with the first hair binding terminal and the second hair binding terminal, tightly connected between the bow head and the frog;

a locking screw, detachably connected to the bow head and the first hair binding terminal, wherein the locking screw is tightened to fix the first hair binding terminal at the first groove and loosened to release the first hair binding terminal which is fixed, in such a manner that the first hair binding terminal is detachably fixed in the bow head; and a cover, provided above the second groove, and slidably provided on the surface of the frog, wherein the cover slides into the frog to cover up the second hair binding terminal, so as to restrict the second hair binding terminal within the second groove, and slides out of the frog to release the second hair binding terminal which is restricted, in such a manner that the second hair binding terminal is detachably fixed in the frog.

2. The bow, as recited in claim 1, further comprising a hair separating grating, provided between the first hair binding terminal and the second hair binding terminal, wherein the hair separating grating has a plurality of through-holes horizontally and evenly arranged; accordingly, the bow hair is evenly separated into a plurality of groups which respectively penetrate through the through-holes, so as to be flat and evenly connected between the bow head and the frog.

3. The bow, as recited in claim 2, wherein a cross section of the first hair binding terminal matches with a cross section of the first groove; the cross section of the first hair binding terminal has a tenon, and the cross section of the first groove has a mortise for mutually engaging with the tenon, in such a manner that the first hair binding terminal is embedded into or detached from the bow head merely transversally along the first groove.

4. The bow, as recited in claim 3, wherein the first hair binding terminal comprises an upper plate and a lower plate which are stacked with each other; a bottom surface of the upper plate has a first row of serrations, and a top surface of the lower plate has a second row of serrations for mutually engaging with the first row of serrations; the front end of the bow hair is clipped between the first row of serrations and the second row of serrations, so as to be mounted inside the first hair binding terminal.

5. The bow, as recited in claim 4, wherein the frog has a pair of rails, provided on the surface of the frog and above the second groove, for allowing the cover to slide back and forth through the rails.

6. The bow, as recited in claim 5, wherein the surface of the frog has at least two second grooves which are arranged horizontally; a distance from each second groove to the first groove successively enlarges, respectively for fixing the bow hair of different lengths, so as to adapt to a gradual elongation of the bow hair.

7. The bow, as recited in claim 6, wherein the second hair binding terminal has the same shape with each the second groove, in such a manner that the second hair binding terminal is exactly and wholly embedded into each the second groove.

8. The bow, as recited in claim 7, wherein the cross section of the first hair binding terminal is in an upper and lower symmetry, or in a left and right symmetry; the cross section of the second hair binding terminal is in a left and right symmetry.

9. The bow, as recited in claim 8, wherein the locking screw is vertical to the first groove.

10. The bow, as recited in claim 9, wherein the first groove is intercommunicated between a left side and a right side of the bow head.

* * * * *